US011346346B2

(12) United States Patent
Kotani

(10) Patent No.: US 11,346,346 B2
(45) Date of Patent: May 31, 2022

(54) LIQUID-COOLED TYPE COMPRESSOR HAVING FIRST AND SECOND NOZZLE INJECTION PORTS WITH DIFFERENT CHARACTERISTICS

(71) Applicant: Hitachi, Ltd., Tokyo (JP)

(72) Inventor: Masanao Kotani, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 100 days.

(21) Appl. No.: 16/769,508

(22) PCT Filed: Nov. 13, 2018

(86) PCT No.: PCT/JP2018/041977
§ 371 (c)(1),
(2) Date: Jun. 3, 2020

(87) PCT Pub. No.: WO2019/111650
PCT Pub. Date: Jun. 13, 2019

(65) Prior Publication Data

US 2021/0190060 A1 Jun. 24, 2021

(30) Foreign Application Priority Data

Dec. 8, 2017 (JP) ..... JP2017-235688

(51) Int. Cl.
*F04C 29/04* (2006.01)
*F04B 39/06* (2006.01)
*F04C 29/00* (2006.01)

(52) U.S. Cl.
CPC ..... *F04C 29/042* (2013.01); *F04B 39/06* (2013.01); *F04B 39/062* (2013.01); *F04C 29/0007* (2013.01); *F04C 2210/221* (2013.01)

(58) Field of Classification Search
CPC ..... F04B 39/02–068; F04C 29/02–047
See application file for complete search history.

(56) References Cited

U.S. PATENT DOCUMENTS 3,820,923 A * 6/1974 Zweifel ..... F04C 29/0007 418/84
2011/0014077 A1 1/2011 Martens

FOREIGN PATENT DOCUMENTS

DE 2720214 A1 * 12/1977 ..... F04C 29/0007
JP 54-40347 A 3/1979
(Continued)

OTHER PUBLICATIONS

International Search Report (PCT/ISA/210) issued in PCT Application No. PCT/JP2018/041977 dated Jan. 29, 2019 with English translation (three pages).
(Continued)

*Primary Examiner* — Laert Dounis
(74) *Attorney, Agent, or Firm* — Crowell & Moring LLP

(57) ABSTRACT

The present invention effectively cools air in a compression process at a high stage when an oil is supplied at the same pressure at a low stage and the high stage. Provided is a liquid-cooled type compressor including: a liquid-cooled type compressor body; at least one first nozzle; and at least one second nozzle, the at least one first nozzle and the at least one second nozzle each having a plurality of injection ports per nozzle and supplying a refrigerant through the injection ports into an inside of the compressor body, the second nozzle having the injection ports each having a diameter larger than a diameter of each of the injection ports of the first nozzle.

5 Claims, 6 Drawing Sheets

(56) References Cited

FOREIGN PATENT DOCUMENTS

| | | | | | |
|---|---|---|---|---|---|
| JP | 02248678 | A | * | 10/1990 | |
| JP | 11336683 | A | * | 12/1999 | |
| JP | 2011-516771 | A | | 5/2011 | |
| WO | WO-2019093109 | A1 | * | 5/2019 | ..... F04C 18/16 |

OTHER PUBLICATIONS

Japanese-language Written Opinion (PCT/ISA/237) issued in PCT Application No. PCT/JP2018/041977 dated Jan. 29, 2019 (three pages).

International Preliminary Report on Patentability (PCT/IB/338 & PCT/IB/373) issued in PCT Application No. PCT/JP2018/041977 dated Jun. 18, 2020, including English translation of document C2 (Japanese-language Written Opinion (PCT/ISA/237) previously filed on Jun. 3, 2020) (seven (7) pages).

* cited by examiner

LIQUID-COOLED TYPE COMPRESSOR HAVING FIRST AND SECOND NOZZLE INJECTION PORTS WITH DIFFERENT CHARACTERISTICS

TECHNICAL FIELD

The present invention relates to a liquid-cooled type compressor.

BACKGROUND ART

In a liquid-cooled type compressor, a conventional technology for adjusting the quantity of a refrigerant injected into a compression chamber has been known. As an example of this conventional technology, there is JP-2011-516771-A (Patent Document 1)

PRIOR ART DOCUMENT

Patent Document

Patent Document 1: JP 2011-516771 A

SUMMARY OF THE INVENTION

Problem to be Solved by the Invention

In the above-mentioned conventional technology, the pressure of the air, inside the compressor, with which the refrigerant contacts at an oil supply port is stronger as the oil supply port is closer to a delivery port of the compressor (at a higher stage). In other words, since the difference between the pressure possessed by the refrigerator and the pressure inside the compressor is smaller at a higher stage, in the case where the oil is supplied at the same pressure at a low stage and a high stage, the quantity of the refrigerant supplied is smaller at the high stage. As a result, there has been a problem that the cooling amount for cooling the air in the compression process cannot be sufficiently obtained at the high stage, and a reducing effect on compression power cannot be produced sufficiently.

In addition, in order to efficiently cool the air in the compression process by a sprayed refrigerant, the particle diameter of the refrigerant supplied should be sufficiently reduced (particulatized). However, in the case where the oil supply port diameter (or pipeline diameter) is reduced for the particulatization, fluid resistance generated at the oil supply port would be increased, resulting in a lowering in the quantity of a lubricant supplied.

Means for Solving the Problem

In order to solve the above-mentioned problem, the present invention provides, for example, a liquid-cooled type compressor including: a liquid-cooled type compressor body; at least one first nozzle; and at least one second nozzle that is disposed on a high pressure side as compared to the first nozzle. Further, the at least one first nozzle and the at least one second nozzle each has a plurality of injection ports per nozzle and supplies a refrigerant through the injection ports into an inside of the compressor body. Furthermore, the second nozzle has the injection ports each having a diameter larger than a diameter of each of the injection ports of the first nozzle.

Advantages of the Invention

According to the present invention, air in the course of compression can be efficiently cooled, and compression power of a compressor can be reduced.

MODES FOR CARRYING OUT THE INVENTION

Figure 1:
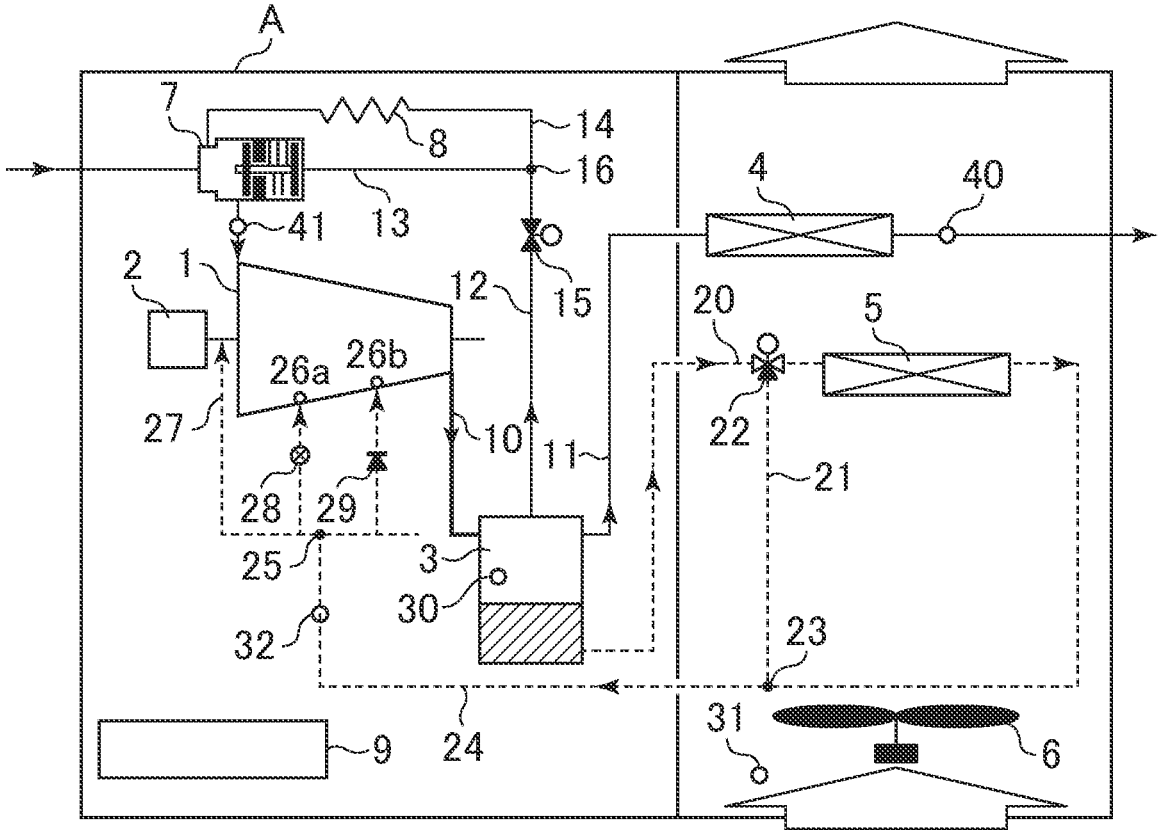
FIG. 1 is an example of drawing for explaining the configuration of an air compression unit.

An air compressor (hereinafter referred in some cases to simply as "compressor") divides a compression process into multiple stages, and a technology of reducing consumption of power for compression by cooling air in the course of compression is well known in thermodynamics. In the case where multiple compression process is divided into multiple stages, since the pressure (of air), inside the compressor, with which a lubricating oil contacts at an oil supply port differs from stage to stage of compression process, so that the difference between the pressure possessed by the lubricating oil and the pressure inside the compressor is reduced as the oil supply port is closer to a delivery port of the compressor (at a higher stage), and the amount of the lubricating oil supplied is reduced with a decrease in the differential pressure. Therefore, as the oil supply port is closer to the delivery port (higher stage), the amount of the lubricating oil supplied is reduced, and cooling amount of air during compression process is also lowered. As a result, there has been a problem in that a sufficient cooling amount of cooling the air in the compression process cannot be obtained, or a reducing effect on compression power cannot be produced sufficiently.

In order to efficiently cool the air in the compression process, the particle diameter of the lubricating oil supplied should be sufficiently reduced (particulatized). However, in the case where the oil supply port diameter (or pipeline diameter) is reduced for the particulatization, fluid resistance generated at the oil supply port would be increased, resulting in a lowering in the quantity of the lubricating oil supplied.

In view of this, the present invention provides an oil-cooled type air compression unit including: an air compressor; an oil separator that separates compressed air and a lubricating oil delivered from the air compressor; an oil cooler that cools the lubricating oil delivered from the oil separator; an after-cooler that cools the air delivered from the air compressor; an air pipeline connected such that the delivered air sequentially flows through the air compressor, the oil separator and the after-cooler; an oil circulation pipeline connected such that the lubricating oil is sequentially circulated through the air compressor, the oil separator and the oil cooler; and a blower that blows cooling air to the oil cooler and the after-cooler, the air compressor being provided with oil supply ports for supplying the lubricating oil to the air in the course of compression, the oil supply ports being provided at (N−1) stages at such positions where the compression process of the air compressor can be divided into N stages, a collision spray type nozzle being used for the oil supply ports, a motor for driving the air compressor being provided with an inverter for changing the quantity of air supplied according to a demanded air quantity by rotational speed of the motor, and a suction throttle valve for controlling the suction amount of the air compressor being provided for coping with a demanded air quantity of equal to or less than a rotational speed lower limit of the inverter. In the oil-cooled type air compression unit, the relationship between a diameter ($d_i$) of the oil supply port at i-th stage or the delivery hole whole sectional area ($A_i$) of the oil supply port at the i-th stage and the diameter ($d_{i+1}$) or the delivery hole whole sectional area ($A_{i+1}$) of the oil supply port at the (i+1)th stage is set as follows:

$$d_{i+1} \geq d_i, \text{ and } A_{i+1} \geq A_i (i=1, \ldots N-1).$$

Alternatively, the relationship between the collision spray angle ($\theta_i$) constituting a nozzle at the oil supply port at the i-th stage and the collision spray angle ($\theta_{i+1}$) of the nozzle at the (i+1)th stage is set as follows:

$$\theta_{i+1} \geq \theta_i (i=1, \ldots N-1).$$

Further, a collision spray type nozzle with a nozzle hole diameter (d) of d≥0.5 mm is provided.

Further, where the center lines of nozzle holes of opposed collision type spray nozzles are extended in a fluid jet direction and the acute angle formed by intersection of the extended two straight lines is defined as collision spray angle, a collision spray type nozzle with collision spray angle in the range of 0°≤θ<150° is provided.

The collision spray type nozzles having such characteristics are used for the multi-stage spray oil-cooled compressor, whereby securement of the particle diameter of the oil sprayed by the nozzles and securement of the required amount of the amount of the lubricating oil supplied from an oil supply port close to the delivery port can both be realized. As a result, the air in the course of compression process can be cooled efficiently, and compression power of the compressor can be reduced.

While the oil-cooled type air compressor will be described below, it is natural that a refrigerant supplied into the compressor body may be other liquid than water and oil.

Embodiment

FIG. 1 is a pipeline drawing for explaining an air compression unit A according to one embodiment of the present invention. The air compression unit A includes: an air compressor (compressor body) 1 that compresses air taken in from the atmosphere; a motor 2 that drives the air compressor 1; an oil separator (oil separator) 3 that separate compressed air containing an oil component into an oil and air; an after-cooler 4 that cools the compressed air; an oil cooler 5 that cools a lubricating oil; a blower 6 for blowing air (indicated by outline arrow in FIG. 1) to the after-cooler 4 and the oil cooler 5; an air pipeline 11 (a pipeline depicted in solid line in FIG. 1) for passing the compressed air; an oil circulation pipeline 20 (a pipeline depicted in broken line in FIG. 1) for connecting the oil separator 3 and the oil cooler 5; an oil circulation pipeline 24 (a pipeline depicted in broken line in FIG. 1) for recirculating the lubricating oil from the oil cooler 5 to the compressor 1; intermediate oil supply sections 26*a* and 26*b* for supplying the lubricating oil to an intermediate section of the compressor; a bearing oil supply section 27 for supplying the lubricating oil to bearings; a bypass pipeline 21 and a three-way valve 22 for bypassing the oil cooler 5 and connecting between the oil circulation pipelines; a two-way valve 15 that controls a suction throttle valve 7 at the time of changing over the operation mode of the air compressor 1 between a "load operation" and a "no-load operation"; a flow control valve 28 for controlling the distribution ratios of the lubricating oil to be supplied to the intermediate oil supply section 26*a* and the intermediate oil supply section 26*b* and the bearing oil supply section 27; a check valve 29 for preventing reverse flow of the lubricating oil or air from the intermediate oil supply section 26*b* to the intermediate oil supply section 26*a* or the bearing oil supply section 27; and the suction throttle valve 7 for controlling the quantity of air sucked into the air compressor 1.

Further, the air compressor unit A includes: temperature detecting means (delivery air temperature detecting means) 30 that detects the temperature of air delivered from the air compressor 1 (the temperature of air inside the oil separator 3); temperature detecting means (outside air temperature detecting means) 31 that detects the temperature of air around the air compression unit A and the temperature of air sucked by the air compressor 1; and temperature detecting means (oil temperature detecting means) 32 that detects the temperature of the lubricating oil flowing into the bearing oil supply section 27 and the intermediate oil supply sections 26*a* and 26*b*, and the rotational speed ($N_f$) of the blower and the opening of the flow control valve 28 are controlled based on the temperatures detected by the temperature detecting means 30, 31 and 32.

In addition, the air compressor unit A includes: pressure detecting means 40 for detecting the pressure of air delivered from the air compressor 1; and pressure detecting means 41 for detecting the pressure of air sucked by the air compressor 1, and can control the flow rate of air delivered from the air compressor 1 according to the detected pressures.

A controller 9 of the air compressor 1 controls the rotational speed ($N_{cp}$) of the air compressor 1, the rotational speed ($N_f$) of the blower 6, the opening of the flow control valve 28, and the opening/closing of the three-way valve 22 and the two-way valve 15. The opening/closing of the suction throttle valve 7 is performed as follows. When the two-way valve 15 is in an open state, high-pressure air stored in the oil separator 3 flows into a connection pipe 12, a high pressure is attained at one end of the suction throttle valve 7, and a valve body of the suction throttle valve is put into a closed state. Simultaneously, the high-pressure air in the oil separator 3 is bypassed to a suction port through a connection pipe 14. Therefore, the pressure inside the oil separator 3 can be lowered. When the two-way valve 15 is in a closed state, the pressure of sucked air (atmospheric pressure) is attained at the one end of the suction throttle valve. Therefore, a pressure difference between both ends of the valve body is eliminated, the throttle valve 7 is put into an open state, and the suction air amount of the air compressor 1 is recovered.

Note that drain water generated at the after-cooler 4 is put to a draining treatment through a drain trap or the like which is not illustrated.

Figure 2A:
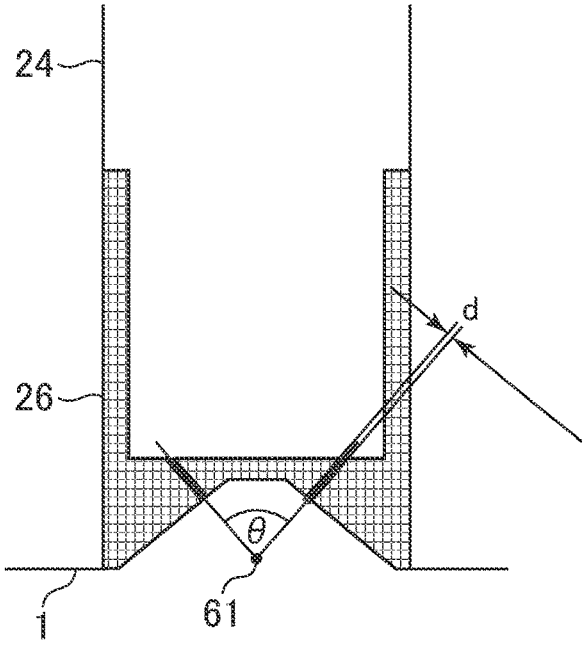
FIG. 2A is an example of drawing for explaining the structure of a collision spray nozzle.

FIG. 2A is an example of drawing depicting the sectional structure of a spray nozzle of the intermediate oil supply section 26 of the air compressor unit A. In FIG. 2A, the inside of the compressor body 1 is the lower side in the figure, and the oil circulation pipeline 24 is connected on the upper side in the figure. The lubricating oil supplied at a pressure P to the spray nozzle via the oil circulation pipeline 24 passes through two nozzle holes (injection ports) provided in the spray nozzle, and is supplied into the inside of the compressor body 1.

The two nozzle holes have a nozzle hole diameter of d, and are disposed to face each other at an angle of θ. Therefore, in the case where the lubricating oil is supplied to the spray nozzle at a certain pressure, the lubricating oil portions sprayed from the two nozzle holes collide with each other in the vicinity of a midpoint 61 of the nozzle holes at an angle of θ.

Figure 2B:
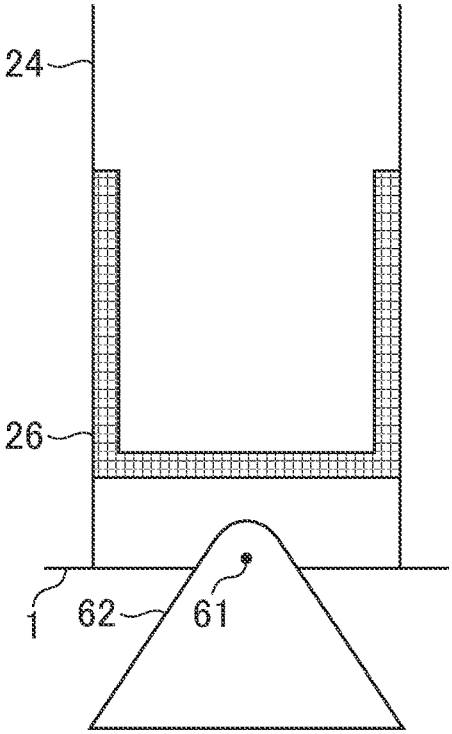
FIG. 2B is an example of drawing for explaining the structure of the collision spray nozzle.

FIG. 2B is an example of drawing depicting the sectional structure as FIG. 2A is viewed sideways. The lubricating oil portions colliding at the midpoint 61 of the nozzle holes diffuse while maintaining a vector which is in a downward direction in FIG. 2B; therefore, the lubricating oil spreads in a fan shape with the arc on the lower side, in a direction perpendicular to the paper surface of FIG. 2B, to form a liquid film 62. In going downward in the liquid film, the lubricating oil tends to be spherical due to surface tension, so that the lubricating oil cannot keep the film shape but is particulatized, and is supplied into the compressor body 1.

The above is a mechanism by which a particulatized lubricating oil is generated by the spray nozzle. Note that FIGS. 2A and 2B are schematic views, and the lubricating oil portions injected may not necessarily collide with each other at the midpoint 61, and the shape of the liquid film 62 generated by the collision of the lubricating oil portions may not necessarily be a vertex-rounded triangle as depicted in FIG. 2B.

Figure 3A:
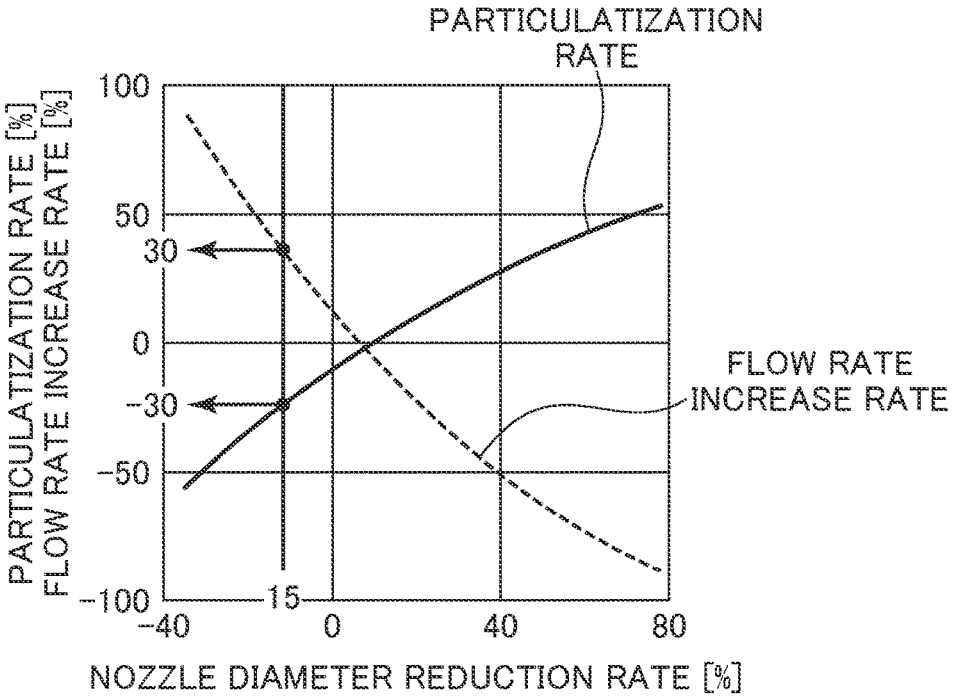
FIG. 3A is an example of drawing representing atomization characteristic and flow characteristic of the collision spray nozzle.
Figure 3B:
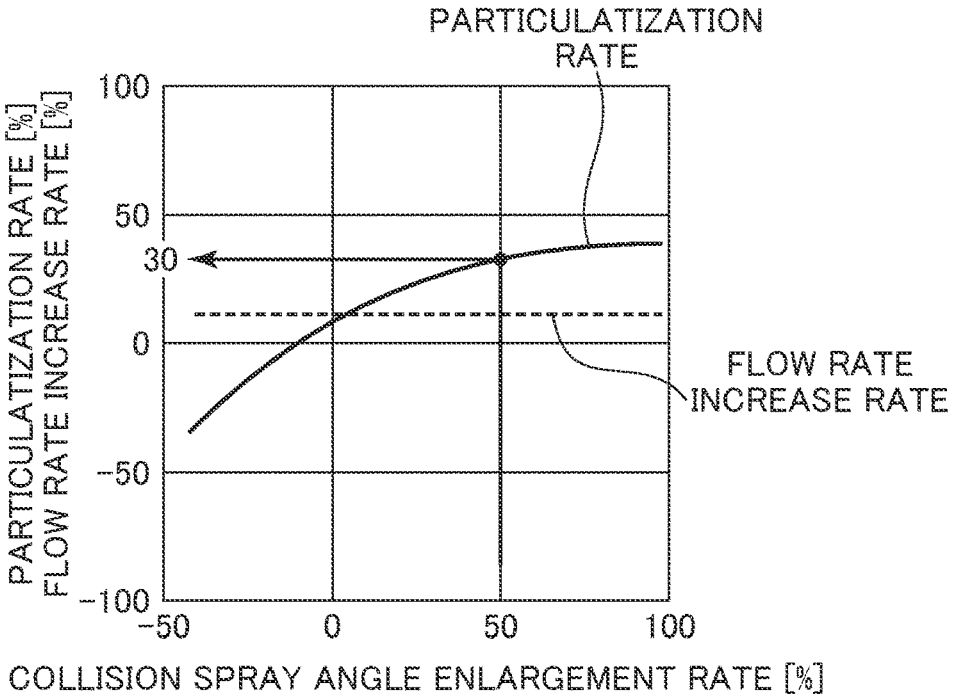
FIG. 3B is an example of drawing representing atomization characteristic and flow characteristic of the collision spray nozzle.

FIG. 3A depicts the relation between particulatization rate ($R_p$) and nozzle flow rate increase rate ($R_v$) when only nozzle hole diameter ($d_i$) is varied against reference nozzle hole diameter ($d_{ist}$) and reference collision spray angle ($\theta_{st}$), and FIG. 3B depicts the relation between particulatization rate ($R_p$) and nozzle flow rate increase rate ($R_v$) when only the collision spray angle (θ) is varied against reference nozzle hole diameter ($d_{ist}$) and reference collision spry angle ($\theta_{st}$). It is to be noted, however, that the pressure difference between flowing-in and flowing-out of the nozzle is constant. Here, nozzle hole diameter reduction rate ($R_d$), collision spray angle enlargement rate ($R_\theta$), particulatization rate ($R_p$) and flow rate increase rate ($R_v$) are given (unit: %) by $$R_d=[(d_{ist}-d_i)/d_{ist}]\times 100,$$

$$R_\theta=[(\theta-\theta_{st})/\theta_{st}]\times 100,$$

$$R_p=[(d_{pst}-d_p)/d_{pst}]\times 100, \text{ and}$$

$$R_v=[(v_t-v_{st})/v_{st}]\times 100.$$

Note that $d_p$ is a spray oil diameter obtained according to variation in nozzle hole diameter ($d_i$) or collision spray angle (θ), and $d_{pst}$ is a reference spray oil diameter obtained from reference nozzle hole diameter ($d_{ist}$) and reference collision spray angle ($\theta_{st}$). Besides, $v_t$ is a nozzle flow rate obtained according to variation in nozzle hole diameter ($d_i$) or collision spray angle (θ), and $v_{st}$ is a reference nozzle flow rate obtained from reference nozzle hole diameter ($d_{ist}$) and reference collision spray angle ($\theta_{st}$).

From FIG. 3A, it is seen that as the nozzle hole diameter becomes smaller, the particle diameter becomes smaller (particulatized), and the quantity of the oil supplied from the nozzle is reduced.

In addition, it is seen from FIG. 3B that although the particle diameter is reduced (particulatized) as the collision spray angle from the nozzle is enlarged, the quantity of the oil supplied from the nozzle is at a constant value independent from the collision spray angle.

Therefore, it is seen that in order to increase the flow rate while maintaining the particle diameter of the oil supplied from the collision spray nozzle, it is sufficient to enlarge the nozzle hole diameter and the collision spray angle.

For example, it is seen from FIG. 3A that when the nozzle hole diameter is enlarged by 15% while maintaining the collision spray angle, the quantity of the oil supplied is increased by 30%, but the particle diameter is enlarged by 30%. In view of this, when the collision spray angle is enlarged by 50% while maintaining the enlarged nozzle hole diameter, the particle size can be reduced (particulatized) by 30% while maintaining the quantity of the oil supplied. As a result, it is seen that an increase in the quantity of the oil supplied while maintaining the particle diameter of the oil supplied can be realized by simultaneously performing enlarging the nozzle hole diameter and enlarging the collision spray angle.

Figure 4:
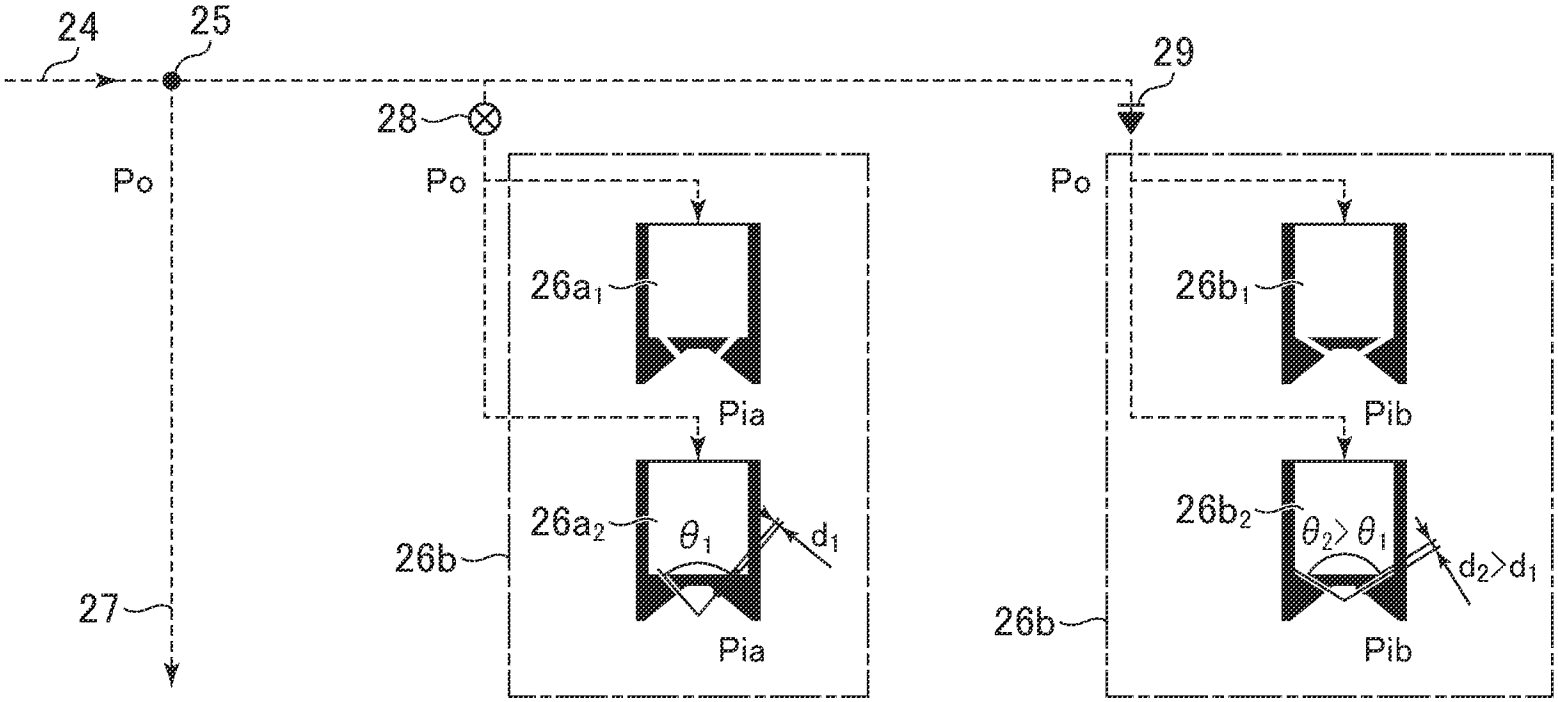
FIG. 4 is an example of drawing for explaining an oil supply route to the collision spray nozzle and the configuration of the collision spray nozzle.

FIG. 4 is a pipeline drawing of an oil piping in which the spray nozzle of the present invention is applied to the air compressor unit A depicted in FIG. 1. As depicted in FIG. 4, the intermediate oil supply section 26*a* and the intermediate oil supply section 26*b* may not each necessarily be provided in the number of one. A plurality of intermediate oil supply section 26$a_1$ and intermediate oil supply section 26$a_2$ disposed at equivalent positions in the axial direction of the compressor body 1 are collectively referred to as the intermediate oil supply section 26*a*, and a plurality of intermediate oil supply section 26$b_1$ and intermediate oil supply section 26$b_2$ disposed at equivalent positions are collectively referred to as the intermediate oil supply section 26*b*. The nozzle hole diameters (d) and collision spray angles (θ) of the oil spray nozzles at the intermediate oil supply section 26*a* (first stage) and the intermediate oil supply section 26*b* (second stage) are made to be $d_1$, $d_2$, $\theta_1$ and $\theta_2$, respectively.

Here, as depicted in FIG. 1 also, a case where the lubricating oil is supplied to the compressor body 1 at the same pressure $P_0$ at the first stage on the lower pressure side and at the second stage on the higher pressure side will be described.

Let nozzle root pressure be $P_0$, let the pressure inside the compressor at the position where the nozzle is disposed be $P_i$, and let pressure loss generated in the spray nozzle be $\Delta P_n(U_i)$, then in order to supply the oil into the compressor, the pressure loss generated in the nozzle should satisfy the relational expression of Math 1. Note that the nozzle root pressure $P_0$ is a pressure higher than any pressure $P_i$ in the compressor ($P_0>P_i$). Where the relational expression of Math 1 is not satisfied, the nozzle is not able to supply the lubricating oil into the compressor. Note that $U_i$ is the flow rate of the lubricating oil flowing in the nozzle, and the value of $\Delta P_n$ is higher as the value of $U_i$ is larger.

$$\Delta P_n(U_i)\leq P_0-P_i \quad \text{(Math 1)}$$

Therefore, allowable pressure losses $\Delta P_{na}(U_{ia})$ and $\Delta P_{nb}(U_{ib})$ at the first stage and the second stage are represented as Math 2 and Math 3 using compressor internal pressures ($P_{ia}$, $P_{ib}$) at the first stage and the second stage.

$$\Delta P_{na}(U_{ia}) \leq P_0 - P_{ia} \quad \text{(Math 2)}$$

$$\Delta P_{nb}(U_{ib}) \leq P_0 - P_{ib} \quad \text{(Math 3)}$$

Here, since the pressure at the second stage is higher than the pressure at the first stage, that is, $P_{ia} < P_{ib}$, in the case where nozzles of the same nozzle hole diameter are applied to the first stage and the second stage, the pressure is reduced from the nozzle at the second stage by the compressor internal pressure difference $\Delta P_i = P_{ib} - P_{ia}$, and the quantity of the lubricating oil supplied from the nozzle at the second nozzle is smaller than the quantity of the lubricating oil supplied from the nozzle at the first stage by an amount corresponding to the differential pressure. Therefore, in order to secure the quantity of the oil supplied from the nozzle at the second stage, the pressure loss across the nozzle at the second stage should be reduced.

For this reason, the quantity of the lubricating oil flowing into the nozzle per nozzle should be reduced and the flow velocity $U_{ib}$ should be lowered, by enlarging the nozzle hole diameter ($d_2$) to lower the flow velocity per nozzle, or by increasing the number of nozzles used at the first stage to enlarge the whole nozzle sectional area ($A_2$).

In the case where the nozzle hole diameter is enlarged in order to secure the quantity of the lubricating oil supplied, the particle diameter of the oil would be enlarged and the cooling effect for the compressed air would be lowered, as has been described using FIG. 3A.

Therefore, the nozzle hole diameter is enlarged, and the collision spray angle $\theta_2$ of the oil flowing out from the nozzle is enlarged, whereby the particle diameter of the oil is prevented from being enlarged.

Figure 5:
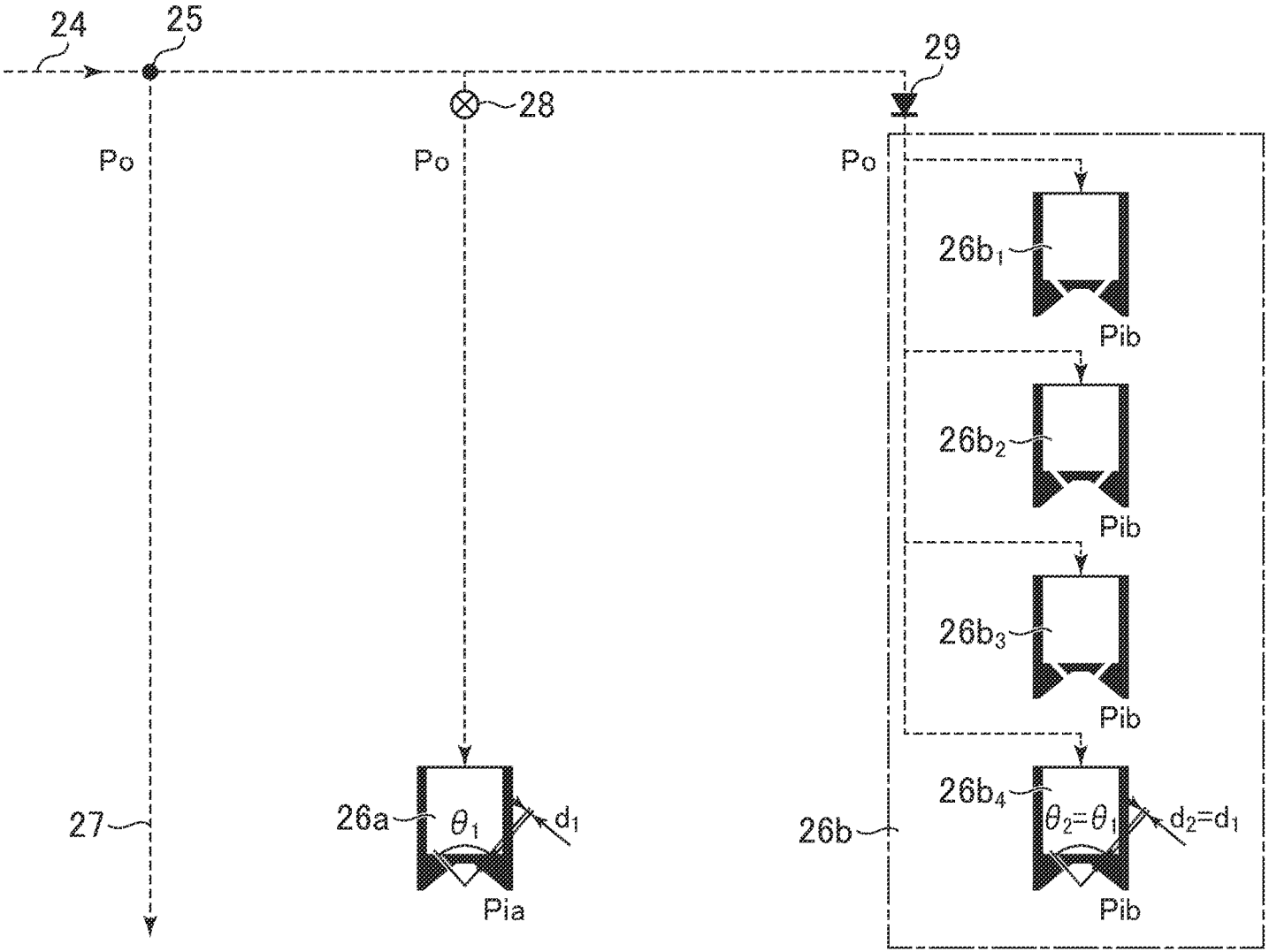
FIG. 5 is an example of drawing for explaining an oil supply route to the collision spray nozzle and the configuration of the collision spray nozzle.

FIG. 5 depicts a pipeline drawing of an oil piping of a second embodiment in which the spray nozzle of the present invention is applied to the air compressor unit A depicted in FIG. 1. As depicted in FIG. 5, according to the second embodiment of the present invention, in the case where the nozzle hole diameter (d) and the collision spray angle ($\theta$) of the oil spray nozzles at the first stage and the second stage take the same values ($d_i = d_2$, $\theta_1 = \theta_2$), such nozzle sectional areas that the compressor internal pressure difference $\Delta P_i = P_{ib} - P_{ia}$ generated between the stages can be canceled may be adopted, whereby, also, the above-mentioned problem can be solved. In other words, the above-mentioned problem can be solved also by a method of providing the nozzles at the second stage in number larger than the number of the nozzles at the first stage. Here, let the nozzle hole sectional area per nozzle at each stage be $A_{ni}$, then the total sectional area of the nozzles is given by $A_i = \Sigma A_{ni}$.

In FIG. 5, in the case where the nozzle delivery hole sectional area at the i-th stage is $A_i$, the delivery hole sectional area ($A_2$) of the nozzle at the second stage is $A_2 = \Sigma A_{2i}$ (i=1 to 4)$=4 \times A_1$, and the quantity of the oil supplied per nozzle can be reduced in the nozzles at the second stage as compared to that in the nozzles at the first stage. As a result, the quantity of oil passing through the nozzle hole (flow velocity) can be reduced, and the pressure loss generated at the nozzle hole can be reduced. As a result, at the nozzles at the second stage, also, both securement of the quality of the lubricating oil and securement of the particle diameter can be realized.

Figure 6:
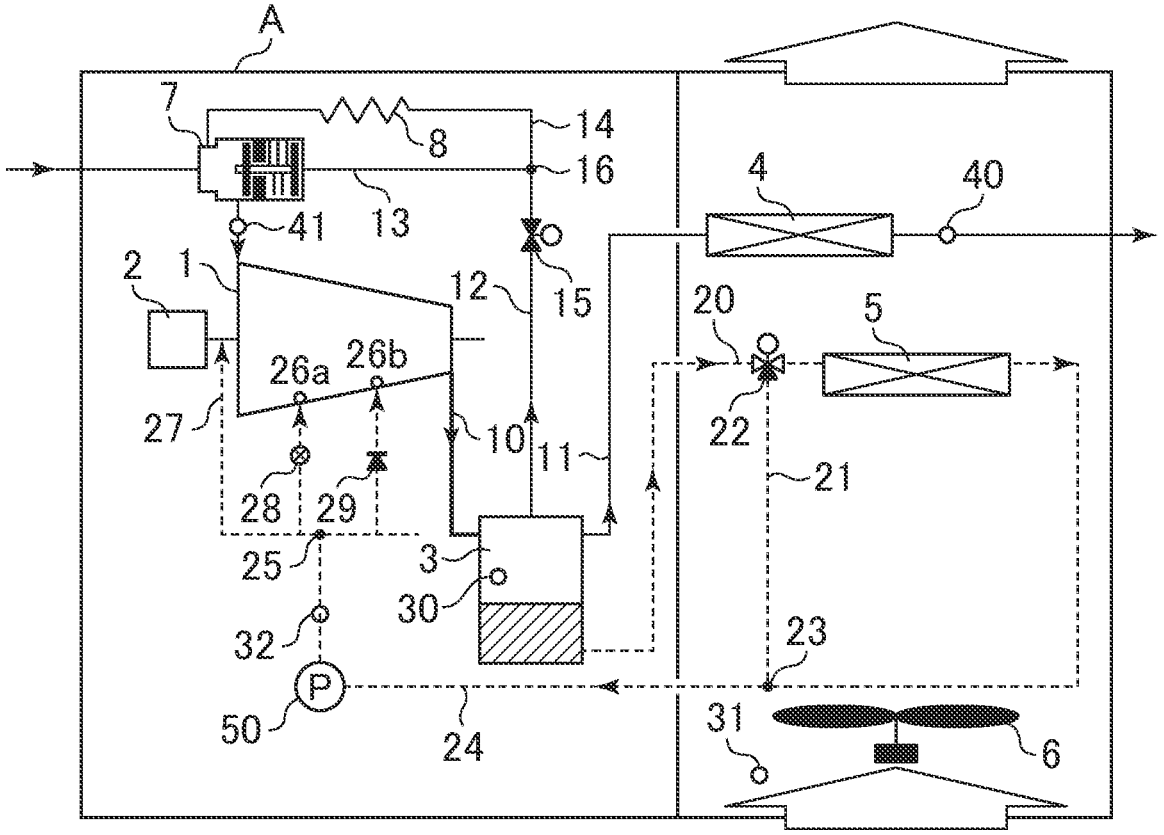
FIG. 6 is an example of drawing for explaining the configuration of the air compression unit.

FIG. 6 depicts a third embodiment in which a booster pump 50 is applied to the oil circulation circuit of the air compressor unit A depicted in FIG. 1. As depicted in FIG. 6, in the present invention, in the case where the booster pump 50 is applied to the oil circulation pump, also, a similar effect can be produced without changing the operation thereof. Note that the booster pump 50 is rather preferably provided at an intermediate part of the oil circulation pipeline 24 on the upstream side of the flow control valve 28 or the check valve 29, since it is ensured that when the oil is decompressed at the time of passing a narrow section of a pipeline, the air engulfed in the oil separator 3 does not bubble. As a result, reliability of the booster pump and the circulation quantity of the oil supplied can be secured. While the embodiment examples of the present invention have been described above, the present invention is not limited to the above embodiment examples, but includes various modifications. For example, while a system divided into three stages of compression process has been described in each of the embodiment examples, a similar effect can be produced also when the number of stages into which the compression process is divided is more than three. In other words, partial configurations of the embodiments may be replaced or modified within such ranges as to satisfy the object of the present invention. In other words, the above-described embodiments are easily understandable explanations of the present invention, and the present invention is not necessarily limited to an embodiment that includes the described configurations.

DESCRIPTION OF REFERENCE CHARACTERS

A: Air compression unit
1: Air compressor (compressor body)
3: Oil separator (oil separator)
4: After-cooler
5: Oil cooler
6: Blower
7: Suction throttle valve
15: Two-way valve
22: Three-way valve
26*a*: Intermediate oil supply section
26*b*: Intermediate oil supply section
27: Bearing oil supply section
28: Flow control valve
29: Check valve
11: Air pipeline
20: Oil circulation pipeline
21: Bypass pipeline
24: Oil circulation pipeline
30: Temperature detecting means (delivery air temperature detecting means)
31: Temperature detecting means (outside air temperature detecting means)
32: Temperature detecting means (oil temperature detecting means)
40: Pressure detecting means (delivery air pressure)
41: Pressure detecting means (suction air pressure)

The invention claimed is:

1. A liquid-cooled type compressor comprising:
a liquid-cooled type compressor body;
at least one first nozzle; and
at least one second nozzle that is disposed on a high pressure side as compared to the at least one first nozzle,
the at least one first nozzle and the at least one second nozzle each having a plurality of injection ports per nozzle and supplying a refrigerant through the injection ports into an inside of the compressor body, the at least one second nozzle having the injection ports each having a diameter larger than a diameter of each of the injection ports of the at least one first nozzle, wherein an angle formed between the plurality of injection ports of the at least one second nozzle is larger than an angle formed between the plurality of injection ports of the at least one first nozzle.

2. The liquid-cooled type compressor according to claim 1, wherein the number of the at least one second nozzle is greater than the number of the at least one first nozzle.

3. The liquid-cooled type compressor according to claim 1, wherein the diameters of the injection ports of the at least one first nozzle and those of the at least one second nozzle are equal to or more than 0.5 mm.

4. The liquid-cooled type compressor according to claim 1, wherein the angles θ formed between the plurality of injection ports are all $0° \leq \theta < 150°$.

5. A liquid-cooled type compressor comprising:

a liquid-cooled type compressor body;

at least one first nozzle; and at least one second nozzle that is disposed on a high pressure side as compared to the at least one first nozzle, the at least one first nozzle and the at least one second nozzle each having a plurality of injection ports per nozzle and supplying a refrigerant through the injection ports into an inside of the compressor body, wherein the number of the at least one second nozzle is greater than the number of the at least one first nozzle, and an angle formed between the plurality of injection ports of the at least one second nozzle is larger than an angle formed between the plurality of injection ports of the at least one first nozzle.

* * * * *